US006640396B1

(12) United States Patent
Lin

(10) Patent No.: US 6,640,396 B1
(45) Date of Patent: Nov. 4, 2003

(54) TENSIONING/RELEASING MECHANISM FOR A BUCKLE DEVICE OF A SKATE

(76) Inventor: Chao-Ming Lin, No. 29, Lane 132, Chu-Wei-Bei Street, Kang-Shan, Kaohsiung Hsien (TW)

( * ) Notice: Subject to any disclaimer, the term of this patent is extended or adjusted under 35 U.S.C. 154(b) by 0 days.

(21) Appl. No.: 10/202,813

(22) Filed: Jul. 25, 2002

(51) Int. Cl.[7] ..... A43C 11/14; A42B 5/04; A42B 11/25

(52) U.S. Cl. ..... 24/68 SK; 24/68 A; 24/69 SK; 24/71 SK; 24/311; 24/308; 24/191

(58) Field of Search ..... 24/68 SK, 68 R, 24/69 R, 69 ST, 69 SK, 71 R, 71 SK, 68 E, 308, 311, 191, 68 A; 254/218

(56) References Cited

U.S. PATENT DOCUMENTS 4,670,946 A * 6/1987 Olivieri ..... 24/71 SK
4,761,859 A * 8/1988 Calabrigo ..... 24/68 SK
5,845,371 A * 12/1998 Chen ..... 24/71 SK
6,055,707 A * 5/2000 Simioni ..... 24/68 SK
6,311,372 B1 * 11/2001 Wang ..... 24/71 SK
6,324,735 B1 * 12/2001 Chen ..... 24/71 SK
6,347,436 B1 * 2/2002 Barber et al. ..... 24/68 SK
6,467,133 B1 * 10/2002 Chen ..... 24/68 SK

* cited by examiner

*Primary Examiner*—Victor Sakran
(74) *Attorney, Agent, or Firm*—Alan D. Kamrath; Rider Bennett LLP.

(57) ABSTRACT

A buckle device for a skate comprises an adjustable receptor fixed to a side of an upper of a boot of a skate, a strap, and a tensioning/releasing mechanism. The tensioning/releasing mechanism comprises a base and a release arm. The base is fixed to another side of the upper of the boot and includes a pivotal seat on an end thereof. The release arm has a first end and a second end pivotally engaged with the pivotal seat. The strap has an end pivoted to the release arm. The release arm is movable between a tensioning position in which the release arm is retained in place relative to the base and the strap is tensioned and a detaching position in which the strap is not tensioned. The second end of the release arm is detachable from the pivotal seat when the release arm is in the detaching position.

7 Claims, 8 Drawing Sheets

TENSIONING/RELEASING MECHANISM FOR A BUCKLE DEVICE OF A SKATE

BACKGROUND OF THE INVENTION

1. Field of the Invention

The present invention relates to a tensioning/releasing mechanism for a buckle device of a skate that allows taking off skate without disengaging a strap from an adjustable receptor on the skate.

2. Description of the Related Art

Skating is a popular sport, as it is exciting and fun. A buckle device is provided on the skate in order to tightly wrap the shank and the foot of the skater while avoiding troublesome taking off of the skate. FIG. 1 of the drawings illustrates a conventional buckle device for a skate. The buckle device includes a tensioning/releasing mechanism 1, an adjustable receptor 2, and a strap 3. The tensioning/releasing mechanism I is fixed by a base 11 to a side of an upper 4 of a boot of a skate. The adjustable receptor 2 includes a fixed portion 21 that is fixed the other side of the upper 4. The strap 3 includes an end extending through the adjustable receptor 2. The strap 3 further includes a plurality of ratchet teeth 31 on an outer side thereof, each ratchet tooth 31 having a stop face 311 and a slide face 312. A lever 22 is pivotally mounted on the fixed portion 21 of the adjustable receptor 2 and includes a catch (not shown). When in a normal state (i.e., the lever 22 is not pushed), the catch is engaged with the stop face 311 of an associated ratchet tooth 31 such that the strap 3 can only be moved along a tightening direction relative to the adjustable receptor 2. When the lever 22 is pushed, the catch is disengaged from the stop face 311 of the associated tooth 31, allowing movement of the strap 3 in a loosening direction. The strap 3 may be completely disengaged from the adjustable receptor 2 when taking off the skate. A release arm 12 is pivoted at 122 (FIG. 2) to the base 11 of the tensioning/releasing mechanism 1. The other end 32 of the strap 3 is pivoted at 123 to the release arm 12. Thus, when in a state shown in FIG. 1, the strap 3 is in a tensioned state for skating. When taking off of the skate is required, the release arm 12 is pivoted to a position shown in FIG. 2, the lever 22 is pushed, and the strap 3 is then pulled out of the adjustable receptor 2, which is troublesome to the skater. Further, when the skater wears the skate next time, he or she has to pass an end of the strap 3 through the adjustable receptor 2, move the release lever 12 to the position shown in FIG. 1, and then move the strap 3 relative to the adjustable receptor 2 until a desired tightness or tension is obtained. Further, the release lever 12 is retained in place by a hook 121 releasably engaged in a slot (not shown) in the base 11, and it was found that the release arm 12 could be inadvertently impinged and thus cause loosening of the buckle device. Risk of injury to the skater exists accordingly.

SUMMARY OF THE INVENTION

An object of the present invention is to provide a tensioning/releasing mechanism for a buckle device of a skate that allows taking off skate without disengaging the strap from the adjustable receptor on the skate.

Another object of the present invention is to provide a tensioning/releasing mechanism for a buckle device of a skate that provides precise tightness for the user for next putting on of the skate.

A buckle device for a skate in accordance with the present invention comprises an adjustable receptor fixed to a side of an upper of a boot of a skate, a strap, and a tensioning/releasing mechanism. The strap has a first end extending through the adjustable receptor and a second end. The strap includes a plurality of ratchet teeth on a side thereof. The adjustable receptor allows the strap to move in a tightening direction when a lever of the adjustable receptor is in a first position. The adjustable receptor allows the strap to move in either a tightening direction or a loosening direction when the lever is in a second position.

The tensioning/releasing mechanism comprises a base and a release arm. The base is fixed to another side of the upper of the boot of the skate and includes a pivotal seat on an end thereof. The release arm has a first end and a second end pivotally engaged with the pivotal seat. The second end of the strap is pivoted to the release arm. The release arm is movable between a tensioning position in which the release arm is retained in place relative to the base and the strap is tensioned and a detaching position in which the strap is not tensioned, the second end of the release arm being detachable from the pivotal seat when the release arm is in the detaching position. Further, the release arm is retained in place when it is in the tensioning position.

The troublesome procedure for taking off and putting on the skate as well as the adjustment of the position of the strap relative to the adjustable receptor in conventional design is avoided by means of the tensioning/releasing mechanism in accordance with the present invention.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
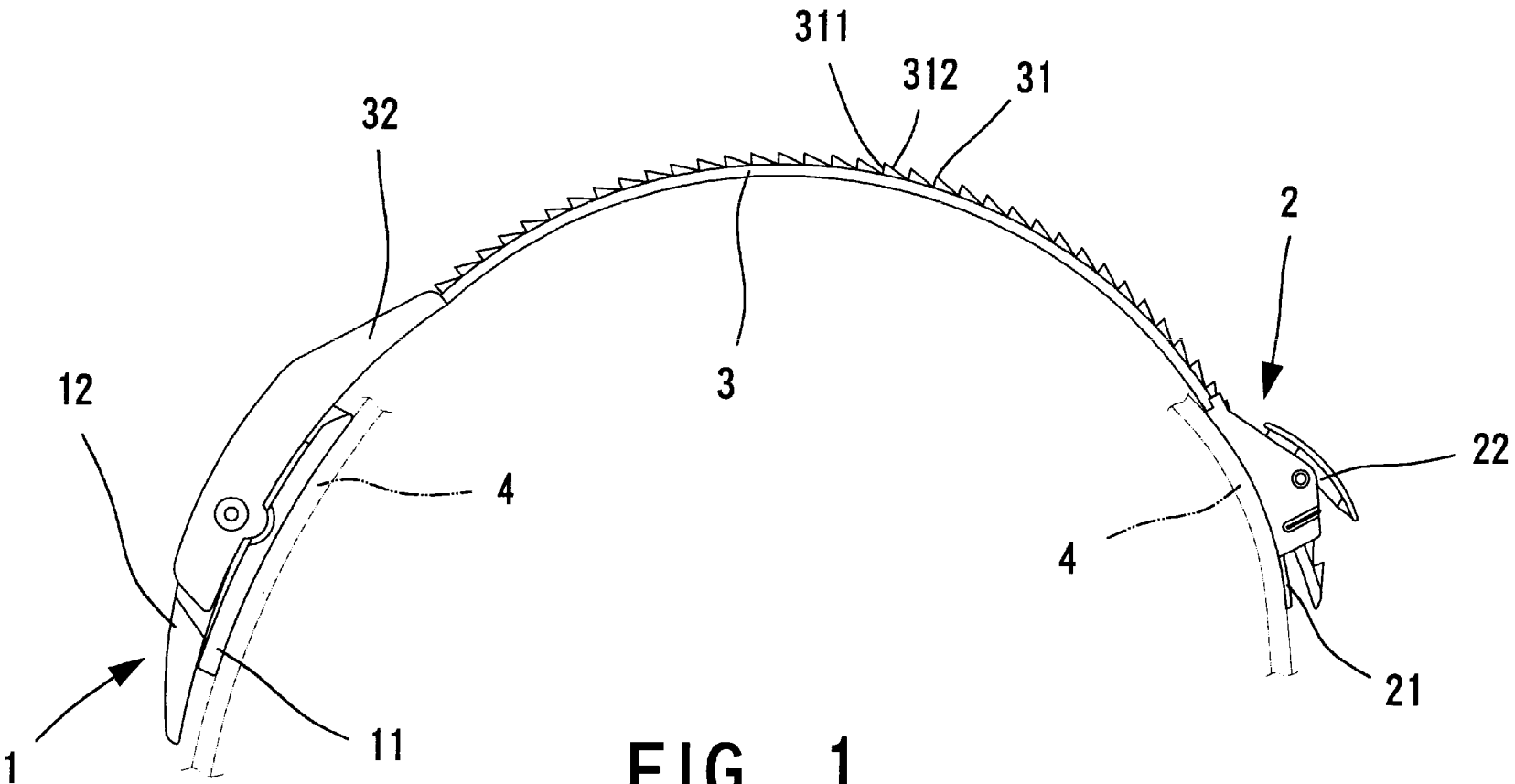
FIG. 1 PRIOR ART
FIG. 1 is a schematic side view of a conventional buckle device for a skate.
Figure 2:
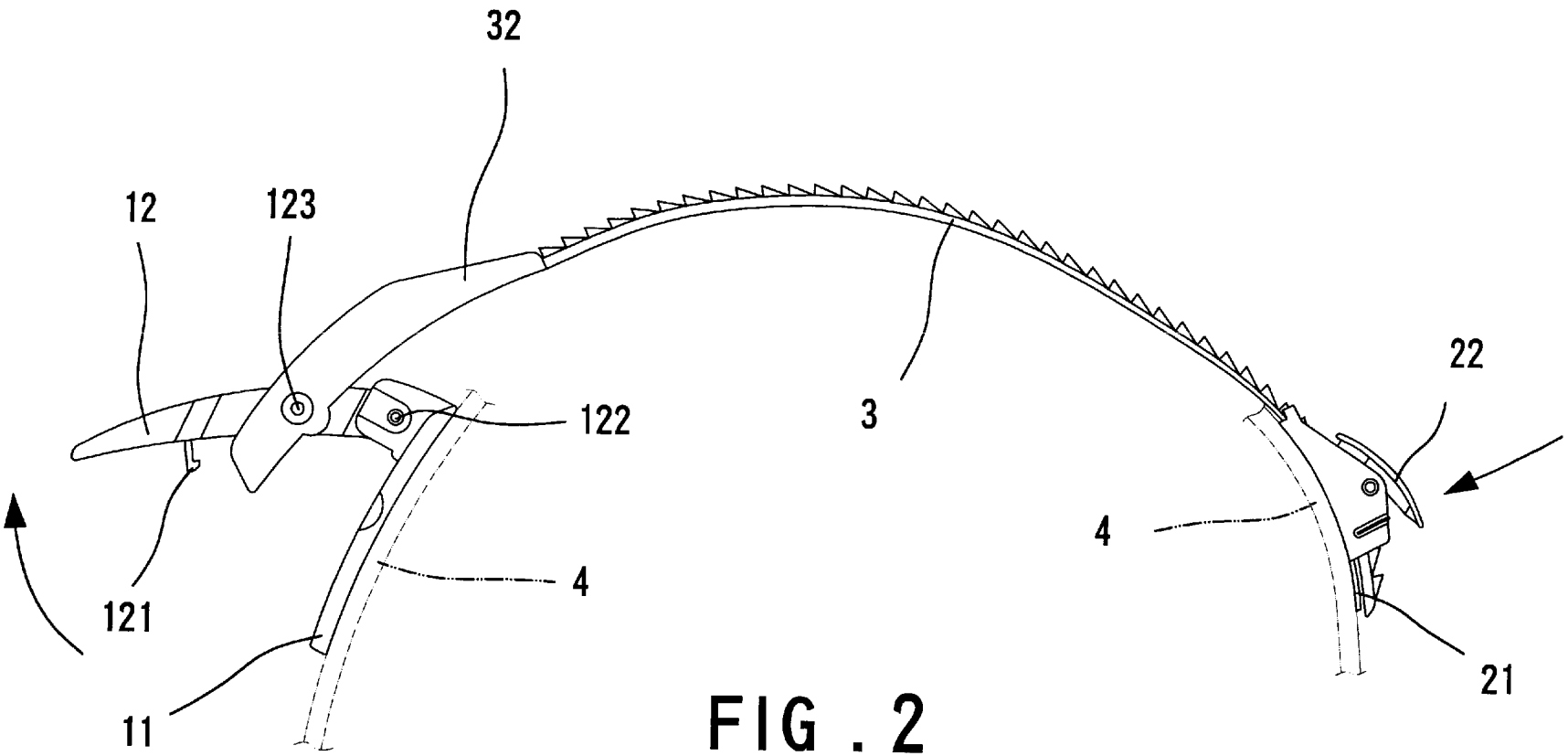
FIG. 2 PRIOR ART
FIG. 2 is a view similar to FIG. 1, illustrating releasing operation of a tensioning/releasing mechanism of the buckle device.
Figure 3:
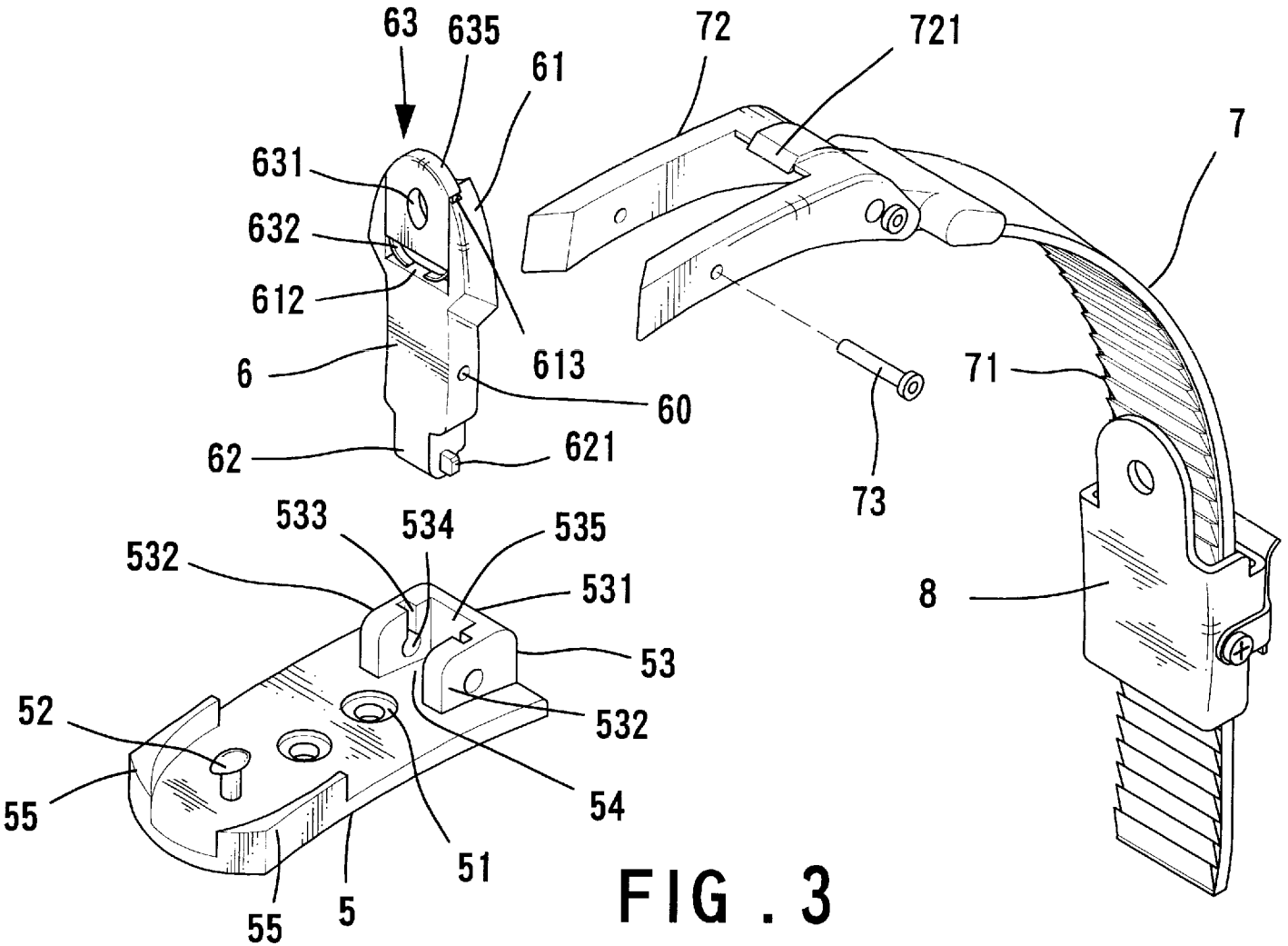
FIG. 3 is an exploded perspective view of a buckle device for a skate in accordance with the present invention.
Figure 4:
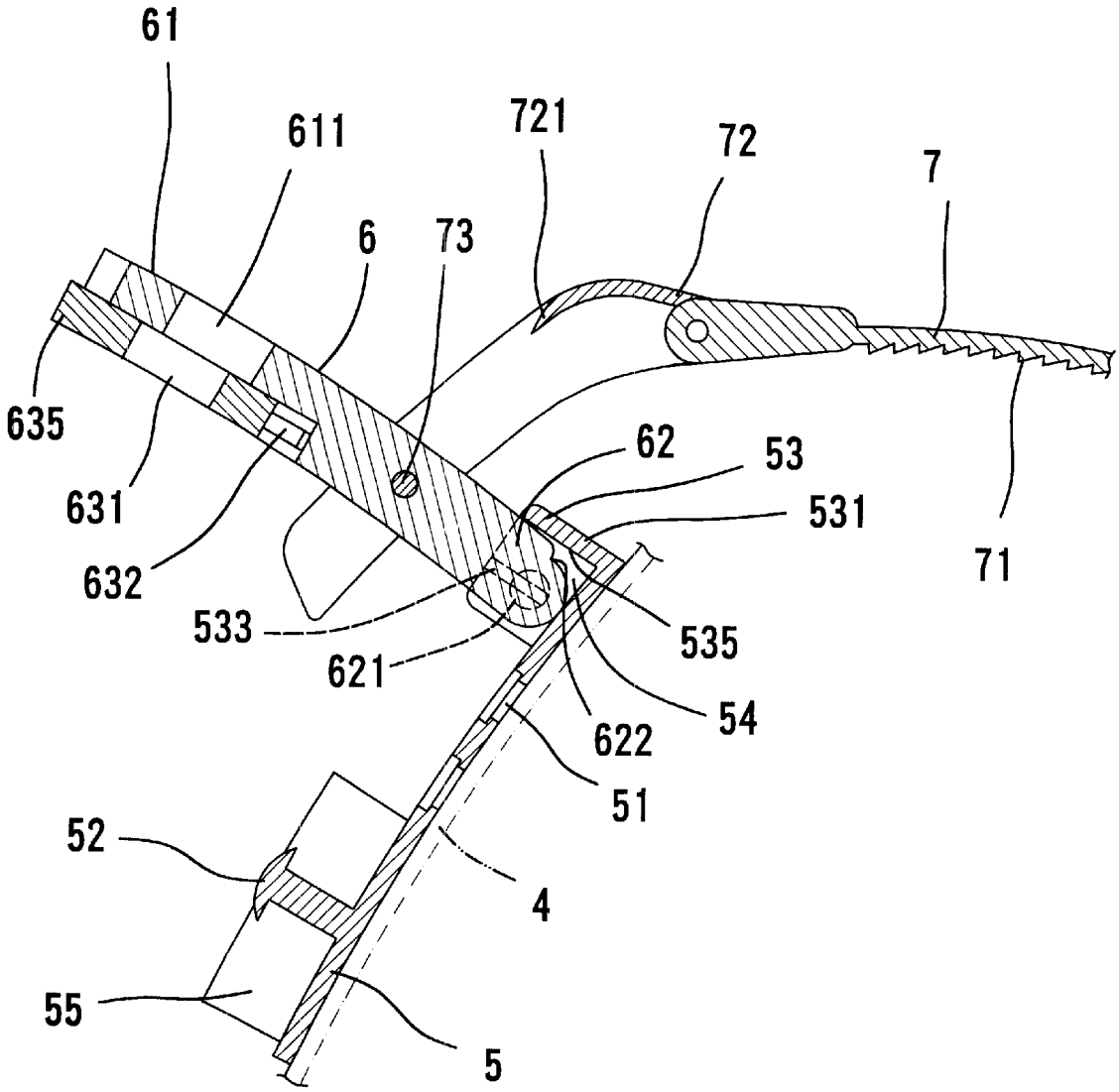
FIG. 4 is a partial sectional view of the buckle device in accordance with the present invention.

Referring to FIG. 3, a buckle device for a skate in accordance with the present invention generally comprises a tensioning/releasing mechanism, an adjustable receptor 8 and a strap 7. The adjustable receptor 8 is fixed to a side of an upper 4 (FIG. 4) of a boot of a skate. An end of the strap 7 is extended through the adjustable receptor 8 and, includes a plurality of ratchet teeth 71. The adjustable receptor 8 allows the strap 7 to move in a tightening direction when a lever (not shown) is in a first position and allows the strap 7 to move in either a tightening direction or a loosening direction when the lever is in a second position. A member 72 is attached to (or extended from) the other end of the strap 7 and includes a beveled face 721.

The tensioning/releasing mechanism in accordance with the present invention comprises a base 5 and a release arm 6. The base 5 includes at least on fixing hole 51 for fixing the base 5 to the other side of the upper 4 of the boot of the skate. The base 5 further includes a hook 52 on an end thereof and a pivotal seat 53 on the other end thereof. Fences 55 are provided along an edge of the first end of the base 5. The pivotal seat 53 includes an end wall 531 and two sidewalls 532, thereby defining a compartment 54. The sidewalls 532 includes aligned guide grooves 533 in opposite inner surfaces thereof, each guide groove 533 having an enlarged inner end 534 and an outer end (not labeled).

The release arm 6 includes a first end 61 having an engaging hole 611 (FIGS. 4 and 7) and a second end 62 having a pintle 621 on each of two sides thereof. Each pintle 621 has a length along a longitudinal direction of the release arm 6 and a width along a transverse direction (or width direction) of the release arm 6. The length of the pintle 621 is larger than the width of the pintle 621.

Figure 7:
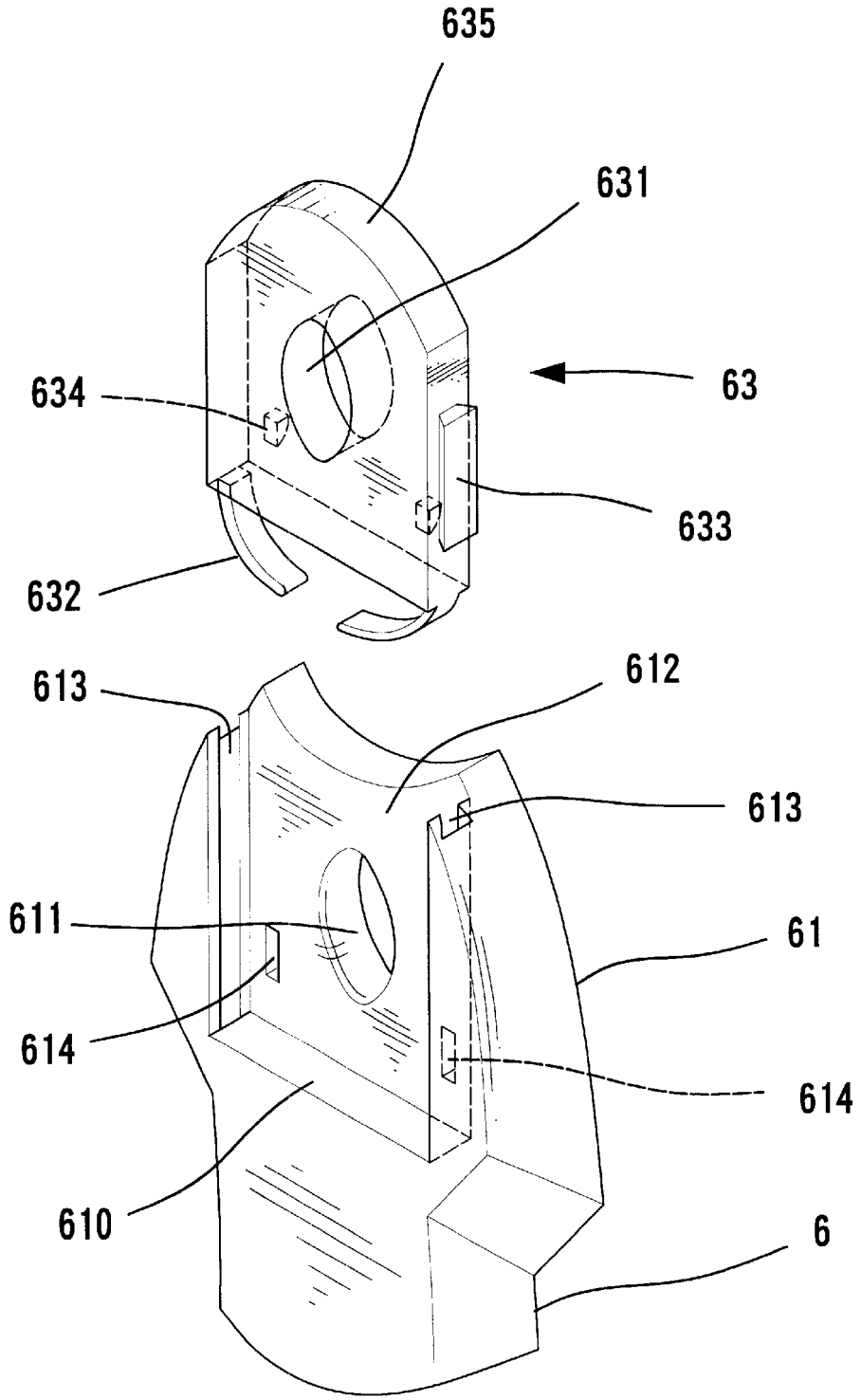
FIG. 7 is an exploded perspective view of a release arm and a push member of the tensioning/releasing mechanism.

Referring to FIG. 7, the release arm 6 further includes a groove 612 in a side of the first end 61, the engaging hole 611 being defined in a bottom wall defining the groove 612 and extending to the other side of the first end 61. Two sidewalls defining the groove 612 include aligned insertion groove or channels 613. Further, at least one engaging slot 614 is defined in the bottom wall defining the groove 612. A push member 63 is slidably mounted in the groove 612 of the release arm 6. In this embodiment, the push member 63 includes insertion members 633 on both sides thereof that are inserted into and slide along the insertion grooves 613 until at least one protrusion 634 on the push member 63 is engaged with the associated engaging slot 614 of the release arm 6. It is noted that the engaging slot 614 is longer than the protrusion 634, thereby allowing sliding movement of the push member 63 relative to the release arm 6. Further, the push member 63 includes a resilient member 632. provided on an end thereof The resilient member 632 abuts against an end wall 610 defining the groove 612.

In assembly, a pin 73 is extended through pinholes 722 in the member 72 attached to (or extended from) the strap 7 and a pinhole 60 in the release arm 6, thereby pivotally connecting the strap 7 and the release arm 6. Each pintle 621 is moved to an upright position shown in FIG. 3 and then inserted along the associated guide groove 533 until it reaches the enlarged inner end 534 of the associated guide groove 533. The release arm 6 is then pivoted to a position shown in FIG. 5, in which the hook 52 is engaged in a through-hole 631 of the push member 63 and the hole 611 of the release arm 6.

Figure 5:
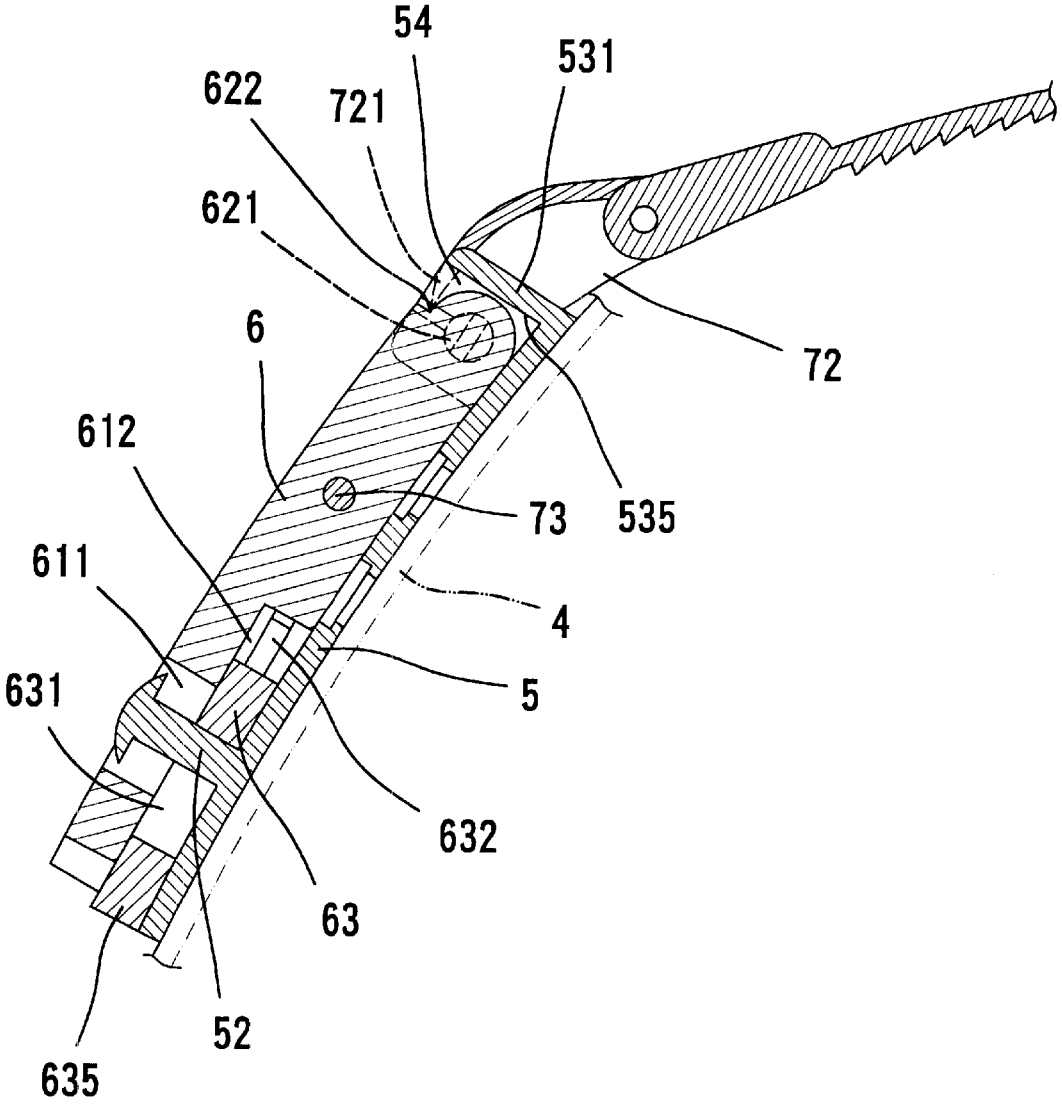
FIG. 5 is a sectional view similar to FIG. 4, wherein a tensioning/releasing mechanism is in a tensioning position.

When the release arm 6 is in a position shown in FIG. 5, the strap 7 is tensioned, and the skater may adjust the position of the strap 7 relative to the adjustable receptor 8 until a desired tightness or tension is obtained. The first end 61 of the release arm 6 is shielded by the fences 55 on the base 5, thereby preventing inadvertent movement of the release arm 6. As a result, the risk of injury to the skater is prevented. Further, as illustrated in FIG. 5, since the through-hole 631 of the push member 63 is not fully aligned with the hole 611 of the release arm 6, pivotal movement of the release arm 6 relative to the base 5 is limited by the push member 63, further preventing possible injury to the skater. Further, an end edge of the beveled face 721 of the member 72 is engaged in a recess 622 of the second end .62 of the release arm 6, further reliably retaining the release arm 6 in place.

Figure 6:
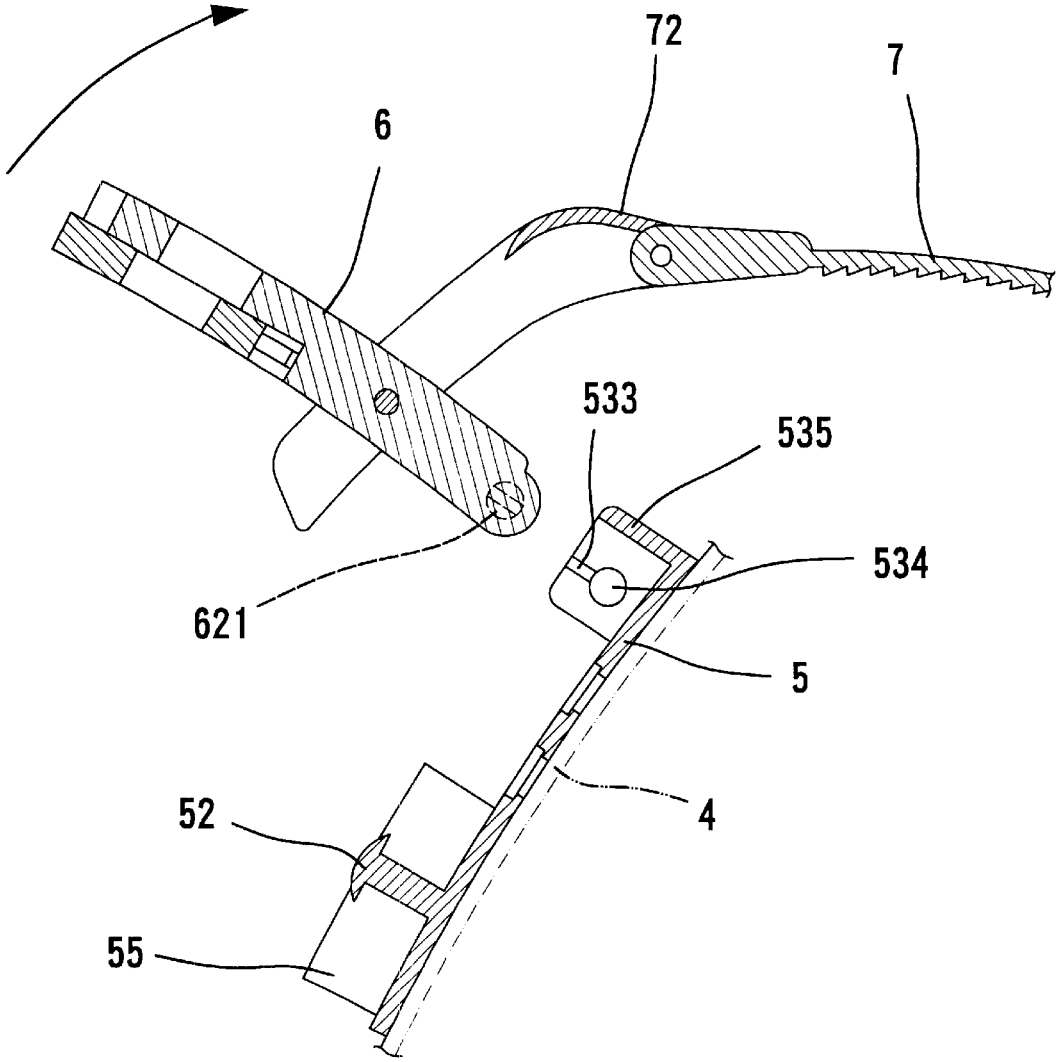
FIG. 6 is a sectional view similar to FIG. 4, wherein the tensioning/releasing mechanism is in a position allowing taking off of the skate.
Figure 8:
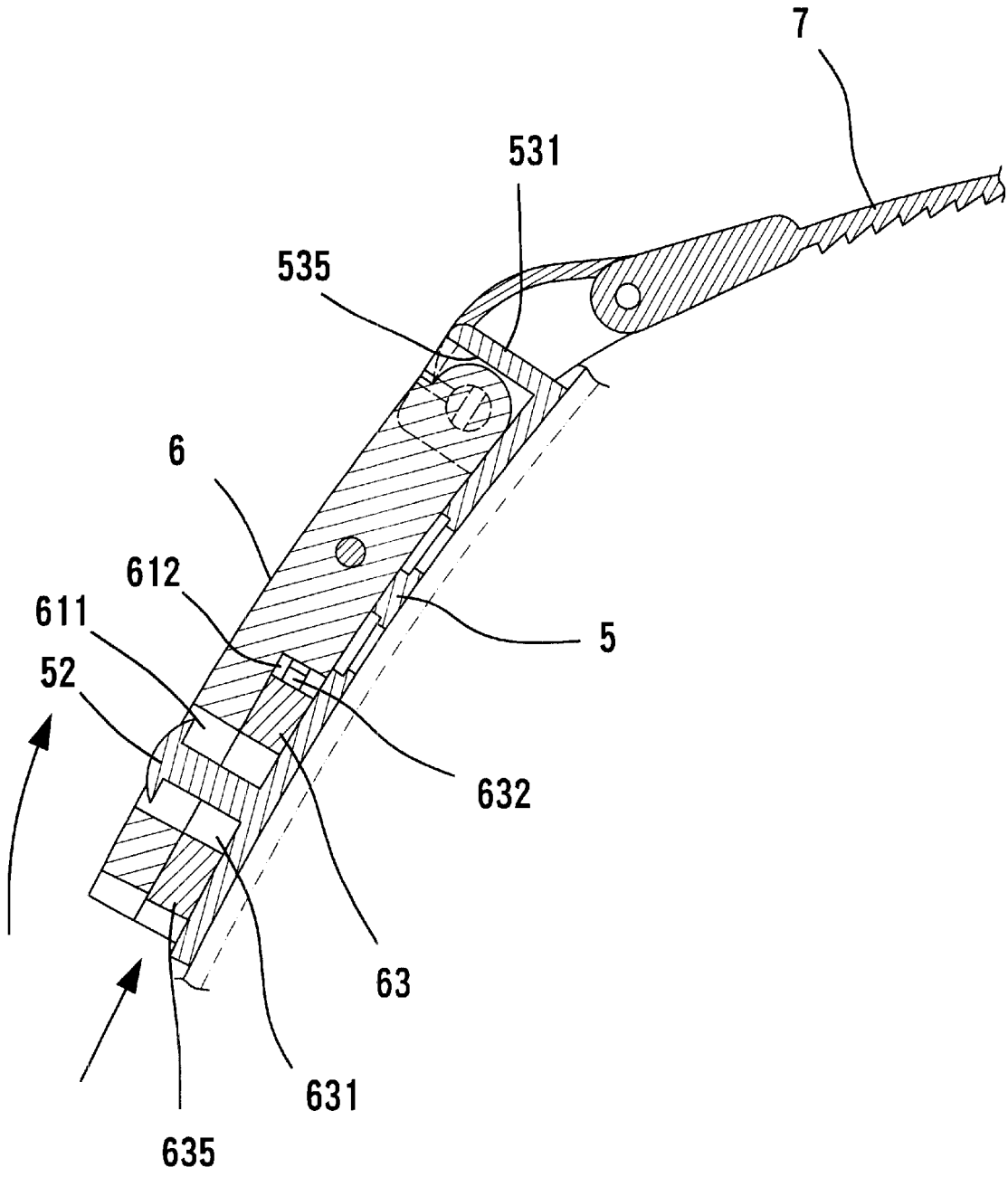
FIG. 8 is a sectional view similar to FIG. 5, illustrating operation of the push member of the tensioning/releasing mechanism.

When taking off of the skate is required, the push member 63 is pushed along an arrow shown in FIG. 8 until the through-hole 631 of the push member 63 is fully aligned with the hole 611 of the release arm 6. Then, the release arm 6 is pivoted relative to the base 5 to a position shown in FIG. 4, in which the release arm 6 is in contact with the abutting face 535 of the end wall 531 of the pivotal seat 53 and in which. the length of each pintle 621 on the release arm 6 is aligned with the associated guide groove 533 of the pivotal seat 53. Next, referring to FIG. 6, the release arm 6 is detached from the pivotal seat 53 and then moved along a direction indicated by the arrow in FIG. 6 as each of the engaging hole 611 of the release. arm 6 and the through-hole 631 of the push member 63 has a diameter greater than a maximum diameter of the hook 52 on the base 5. The skater may then take off the skate. No adjustment of the position of the strap 7 relative to the adjustable receptor 8 is required. Next time when the skater wears the. skate, the procedure for taking off the skate is reversed. Again, no adjustment of the position of the strap 7 relative to the adjustable receptor 8 is required. The required tightness or tensioning of the strap 7 is obtained when the release arm 6 is moved to a position shown in FIG. 5. The abutting face 535 of the pivotal seat 53 provides an indication of the exact detaching position of the release arm 6.

According to the above description, it is appreciated that the troublesome procedure for taking off and putting on the skate as well as the adjustment of the position of the strap relative to the adjustable receptor in conventional design is avoided by means of the tensioning/releasing mechanism in accordance with the present invention. Further, the release arm 6 in accordance with the present invention is reliably retained in place when in its tensioning position. Breakage of the release arm 6 is avoided by the fences 55 on the base 5.

Although the invention has been explained in relation to its preferred embodiment, it is to be understood that many other possible modifications and variations can be made without departing from the scope of the invention as hereinafter claimed.

What is claimed is:

1. A buckle device for a skate, the buckle device comprising:

an adjustable receptor fixed to a side of an upper of a boot of a skate, the adjustable receptor including a lever;

a strap having a first end extending through the adjustable receptor and a second end, the strap including a plurality of ratchet teeth on a side thereof, the adjustable receptor allowing the strap to move in a tightening direction when the lever is in a first position, the adjustable receptor allowing the strap to move in either a tightening direction or a loosening direction when the lever is in a second position; and a tensioning/releasing mechanism comprising:

a base fixed to another side of the upper of the boot of the skate, the base including a pivotal seat on an end thereof, and a release arm having a first end and a second end pivotally engaged with the pivotal seat, the second end of the strap being pivoted to the release arm, the release arm being movable between a tensioning position in which the release arm is retained in place relative to the base and the strap is tensioned and a detaching position in which the strap is not tensioned, the second end of the release arm being detachable from the pivotal seat when the release arm is in the detaching position; and means for retaining the release arm in place when the release arm is in the tensioning position wherein the pivotal seat includes an end wall and two sidewalls, defining a compartment therebetween for pivotally receiving the second end of the release arm, each said sidewall of the pivotal seat including a guide groove having an enlarged end, the second end of the release arm including two sides each having a pintle formed thereon, each said pintle being passable through an associated one of the guide grooves when the release arm is in the detaching position, and each said pintle being pivotally received in the enlarged end of an associated one of the guide grooves and incapable of passing through an associated one of the guide grooves when the release arm is in the tensioning position.

2. The buckle device for a skate as claimed in claim 1, wherein the base includes a hook on another end thereof, the first end of the release arm including a hole, the hook being engaged with the hole when the release arm is in the tensioning position, the hook being disengaged from the hole when the release arm is in the detaching position.

3. The buckle device for a skate as claimed in claim 1, wherein the base includes at least one fence extending along an end edge of another end of the base for guarding the first end of the release arm.

4. A buckle device for a skate, the buckle device comprising:

an adjustable receptor fixed to a side of an upper of a boot of a skate, the adjustable receptor including a lever;

a strap having a first end extending through the adjustable receptor and a second end, the strap including a plurality of ratchet teeth on a side thereof, the adjustable receptor allowing the strap to move in a tightening direction when the lever is in a first position, the adjustable receptor allowing the strap to move in either a tightening direction or a loosening direction when the lever is in a second position; and a tensioning/releasing mechanism comprising:

a base fixed to another side of the upper of the boot of the skate, the base including a pivotal seat on an end thereof, and a release arm having a first end and a second end pivotally engaged with the pivotal seat, the second end of the strap being pivoted to the release arm, the release arm being movable between a tensioning position in which the release arm is retained in place relative to the base and the strap is tensioned and a detaching position in which the strap is not tensioned, the second end of the release arm being detachable from the pivotal seat when the release arm is in the detaching position; and means for retaining the release arm in place when the release arm is in the tensioning position;

wherein the second end of the strap includes a beveled face, the second end of the release arm including a recess, the beveled face including an end edge engaged in the recess when the release arm is in the tensioning position.

5. A buckle device for a skate, the buckle device comprising:

an adjustable receptor fixed to a side of an upper of a boot of a skate, the adjustable receptor including a lever;

a strap having a first end extending through the adjustable receptor and a second end, the strap including a plurality of ratchet teeth on a side thereof, the adjustable receptor allowing the strap to move in a tightening direction when the lever is in a first position, the adjustable receptor allowing the strap to move in either a tightening direction or a loosening direction when the lever is in a second position; and a tensioning/releasing mechanism comprising:

a base fixed to another side of the upper of the boot of the skate, the base including a pivotal seat on an end thereof, and a release arm having a first end and a second end pivotally engaged with the pivotal seat, the second end of the strap being pivoted to the release arm, the release arm being movable between a tensioning position in which the release arm is retained in place relative to the base and the strap is tensioned and a detaching position in which the strap is not tensioned, the second end of the release arm being detachable from the pivotal seat when the release arm is in the detaching position; and means for retaining the release arm in place when the release arm is in the tensioning position;

wherein the base includes a hook on another end thereof, the first end of the release arm including a groove in a side thereof and a hole in a bottom wall defining the groove, the hole extending to another side of the first end of the release arm, a push member being received in the groove of the release arm and slidable between a first position and a second position, the push member including a through-hole, wherein when the push member is in the first position, the hook of the base is engaged in the through-hole of the push member and the engaging hole of the release arm in a manner that pivotal movement of the release arm relative to the base is limited by the push member, and wherein when the push member is in the second position, pivotal movement of the release arm relative to the base is allowed.

6. The buckle device for a skate as claimed in claim 5, wherein the push member further includes a resilient member on an end thereof, the resilient member abutting against an end wall defining the groove of the release arm for returning the push member to the first position.

7. The buckle device for a skate as claimed in claim 6, wherein each of the engaging hole of the release arm and the through-hole of the push member has a diameter greater than a maximum diameter of the hook of the base, and wherein the engaging hole of the release arm is fully aligned with the through-hole of the push member when the push member is in the second position, and wherein the engaging hole of the release arm is not fully aligned with the through-hole of the push member when the push member is in the first position such that the push member impedes pivotal movement of the release arm relative to the base.

* * * * *